US007275464B2

(12) United States Patent
Chervenak et al.

(10) Patent No.: US 7,275,464 B2
(45) Date of Patent: Oct. 2, 2007

(54) RATCHETING ADJUSTABLE WRENCH

(75) Inventors: Thomas M. Chervenak, Stanley, NC (US); Brett Lucus, Huntersville, NC (US); Douglas J. Baxendell, Huntersville, NC (US); James Michael Burry, Troutman, NC (US)

(73) Assignee: Irwin Industrial Tool Company, Huntersville, NC (US)

( * ) Notice: Subject to any disclaimer, the term of this patent is extended or adjusted under 35 U.S.C. 154(b) by 0 days.

(21) Appl. No.: 11/380,986

(22) Filed: May 1, 2006

(65) Prior Publication Data

US 2007/0028725 A1 Feb. 8, 2007

Related U.S. Application Data

(60) Provisional application No. 60/704,798, filed on Aug. 2, 2005.

(51) Int. Cl.
*B25B 13/16* (2006.01)

(52) U.S. Cl. ..... 81/165

(58) Field of Classification Search ..... 81/165, 81/129, 179, 90.1

See application file for complete search history.

(56) References Cited

U.S. PATENT DOCUMENTS

| | | | | |
|---|---|---|---|---|
| 1,397,214 | A | 11/1921 | Hose | |
| 1,830,033 | A | 11/1931 | Larson | |
| 2,351,821 | A | 6/1944 | Larson | |
| 3,926,077 | A * | 12/1975 | Nordgren | 81/126 |
| 5,095,782 | A | 3/1992 | Galea | |
| 5,239,899 | A | 8/1993 | Baker | |
| 5,297,459 | A * | 3/1994 | Stojanowski | 81/165 |
| 5,890,404 | A | 4/1999 | Stojanowski | |
| 5,941,142 | A * | 8/1999 | Janson | 81/165 |
| 6,016,723 | A | 1/2000 | Hillinger | |
| 6,418,819 | B1 | 7/2002 | Kuo | |
| D463,233 | S | 9/2002 | Salazar et al. | |
| 6,530,298 | B1 * | 3/2003 | Steffe | 81/179 |
| 6,595,089 | B1 | 7/2003 | Stojanowski | |
| 6,679,139 | B2 | 1/2004 | Brenizer | |
| 6,941,142 | B2 | 9/2005 | Abramovici et al. | |
| 7,077,034 | B2 | 7/2006 | Harrison | |

OTHER PUBLICATIONS http://www.solsons.com/indwrenchspanner.htm, 2 pages.

* cited by examiner

*Primary Examiner*—Joseph J. Hail, III
*Assistant Examiner*—Shantese L. McDonald
(74) *Attorney, Agent, or Firm*—Dennis J. Williamson; Moore & Van Allen PLLC

(57) ABSTRACT

The wrench comprises a handle that is pivotably connected to a body portion. The body portion supports a fixed jaw. A movable jaw is slidably supported on the body portion such that the movable jaw can move relative to the fixed jaw to vary the spacing between the jaws. When the handle is rotated in a first direction the spacing between the jaws increases to allow the jaws to slip over a work piece and provide a ratchet function. When the handle is rotated in a second direction opposite to the first direction the movable jaw is moved towards the fixed jaw to close on and grip the workpiece. In one embodiment a link moves the movable jaw relative to the fixed jaw and forms part of an dead/over-center locking mechanism.

25 Claims, 11 Drawing Sheets

RATCHETING ADJUSTABLE WRENCH

This application claims the benefit of priority under 35 U.S.C. § 119(e) to the filing date of U.S. Provisional Application 60/704,798 filed on Aug. 2, 2005, which is incorporated by reference in its entirety.

BACKGROUND

The invention relates to wrenches and, more particularly, to a ratcheting adjustable wrench.

It will be appreciated that many different types of wrenches are known including box wrenches, adjustable wrenches and ratcheting wrenches. Adjustable wrenches typically comprise a handle supporting a fixed jaw. A movable jaw is supported on the handle/fixed jaw such that it can move towards and away from the fixed jaw. By adjusting the distance between the fixed and movable jaws, the wrench can grip a range of fastener sizes. One common mechanism for moving the movable jaw is a knurled screw supported on the handle/fixed jaw that engages a rack on the movable jaw. Adjustable wrenches provide the benefit of being able to be used on a variety of different types and sizes of fasteners. One limitation of adjustable wrenches is that it is often necessary to adjust and seat the wrench on the fastener, turn the fastener a partial turn, remove the wrench from the fastener, readjust and reseat the wrench on the fastener and repeat the process. As a result, traditional adjustable wrenches can be cumbersome to use in some applications.

Box-type wrenches typically include an elongated rigid handle having an open box on one end and a closed box on the other end. The boxes are dimensioned to closely receive a particular size fastener. One advantage of a box wrench is that it is very simple to use and provides a fixed engagement between the fastener and the wrench. Because the wrench is size specific, however, it is necessary for a user to have a set of wrenches to accommodate fasteners of different sizes. Organizing, maintaining and using multiple wrenches may be inconvenient. Even with a set of wrenches, the user may find fasteners in sizes that are not well matched to the sizes of wrenches in a particular set. Moreover, like adjustable wrenches, it is often necessary when using box-type wrenches to seat the wrench on the fastener, turn the fastener a partial turn, remove the wrench from the fastener, reseat the wrench on the fastener and repeat the process.

Ratchet wrenches are known where a socket is ratcheted to a handle such that the wrench can tighten or loosen a fastener without removing the wrench from the fastener. Ratchet wrenches may be embodied in combination with a box-type wrench or a socket wrench where the sockets are removably attached to the ratchet handle. These types of wrenches make the operation of the wrench less cumbersome in certain applications because the wrench does not have to be removed from the fastener for multiple turns. One limitation of these wrenches is that like box-type wrenches, these wrenches are not adjustable such that a set of wrenches or sockets is required in order for the wrench to be used on different size fasteners.

Ratcheting adjustable wrenches are also known. These wrenches attempt to combine the convenience of the ratcheting and adjustability functions in a single tool. Combining these two functions has proved difficult, resulting in tools that are relatively complex and may fail when large torques are applied. The complexity of the known devices makes the tools difficult and expensive to manufacture.

Thus, an improved ratcheting adjustable wrench is desired.

SUMMARY OF THE INVENTION

The invention comprises a handle that is pivotably connected to a body portion. The body portion supports a fixed jaw. A movable jaw is slidably supported on the body portion such that the movable jaw can move relative to the fixed jaw to vary the spacing between the jaws. When the handle is rotated in a first direction the spacing between the jaws increases to allow the jaws to slip over a work piece and provide a ratchet function. When the handle is rotated in a second direction opposite to the first direction the movable jaw is moved towards the fixed jaw to close on and grip the workpiece. In one embodiment a link moves the movable jaw relative to the fixed jaw and forms part of an over-center locking mechanism that locks the movable jaw in position relative to the fixed jaw. In another embodiment teeth formed on the handle engages mating teeth formed on the movable jaw engages teeth on the movable jaw to move the movable jaw relative to the fixed jaw.

DETAILED DESCRIPTION OF EMBODIMENTS OF THE INVENTION

Figure 1:
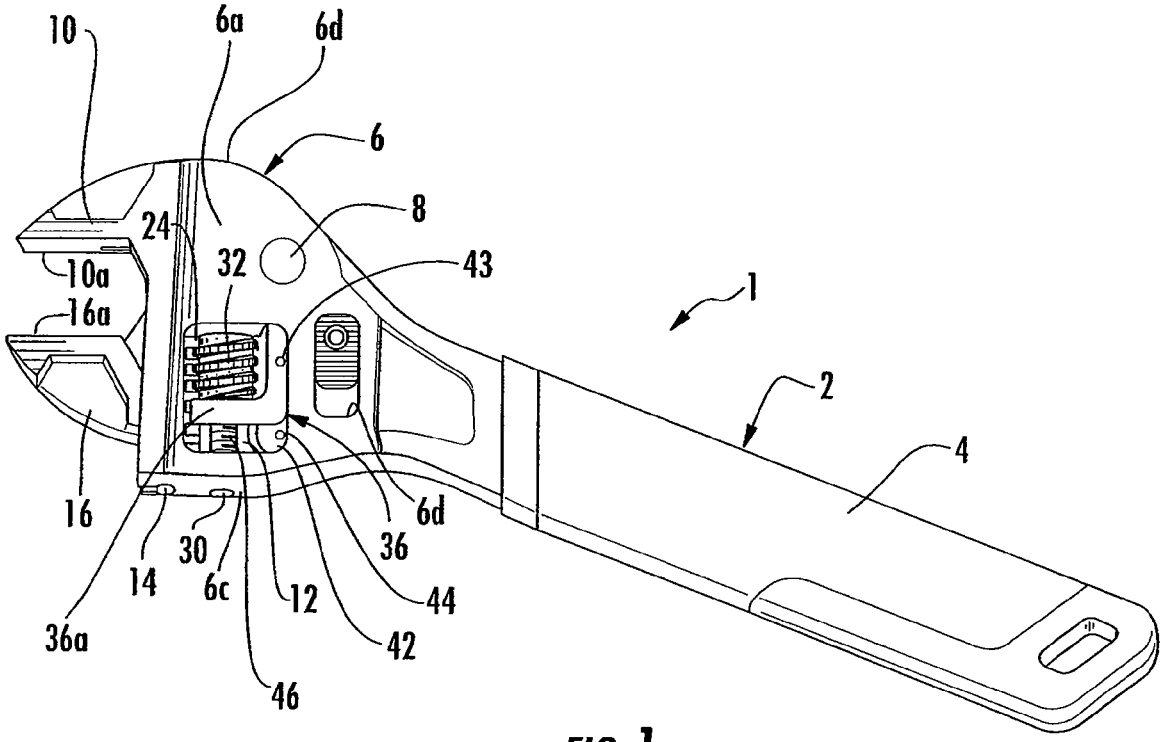
FIG. 1 is a perspective view of one embodiment of the wrench of the invention.
Figure 2:
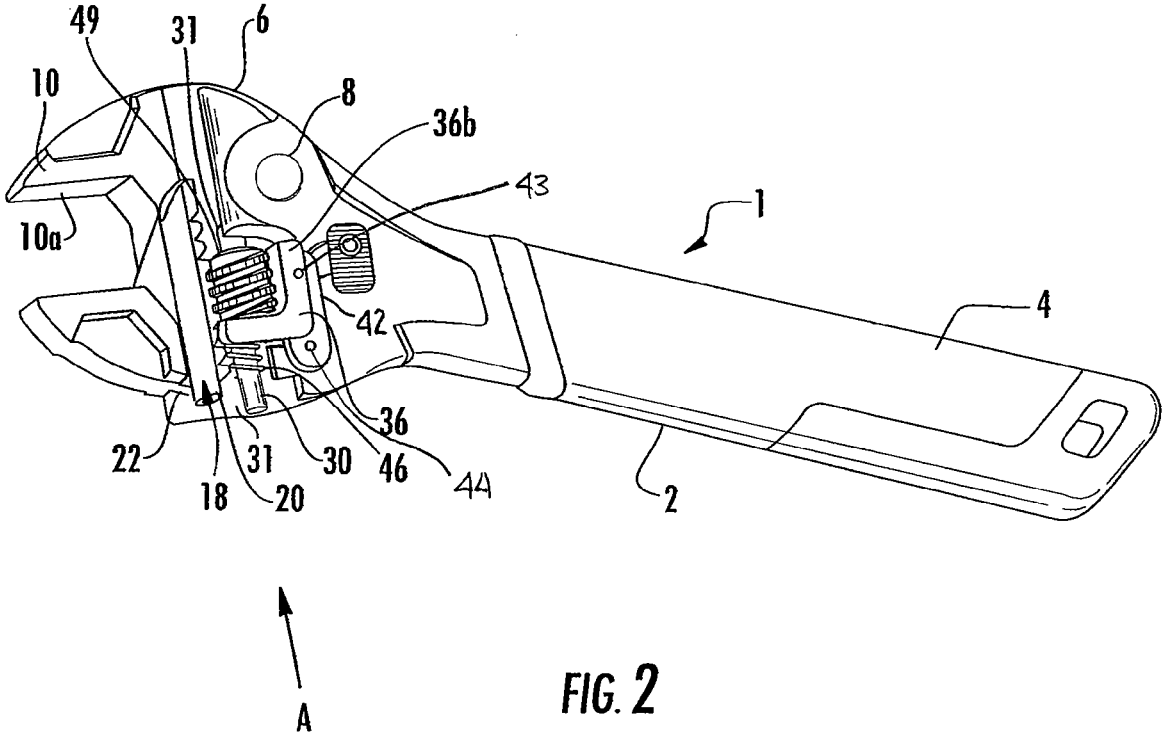
FIG. 2 is a partially cut-away view of the wrench of FIG. 1.
Figure 3:
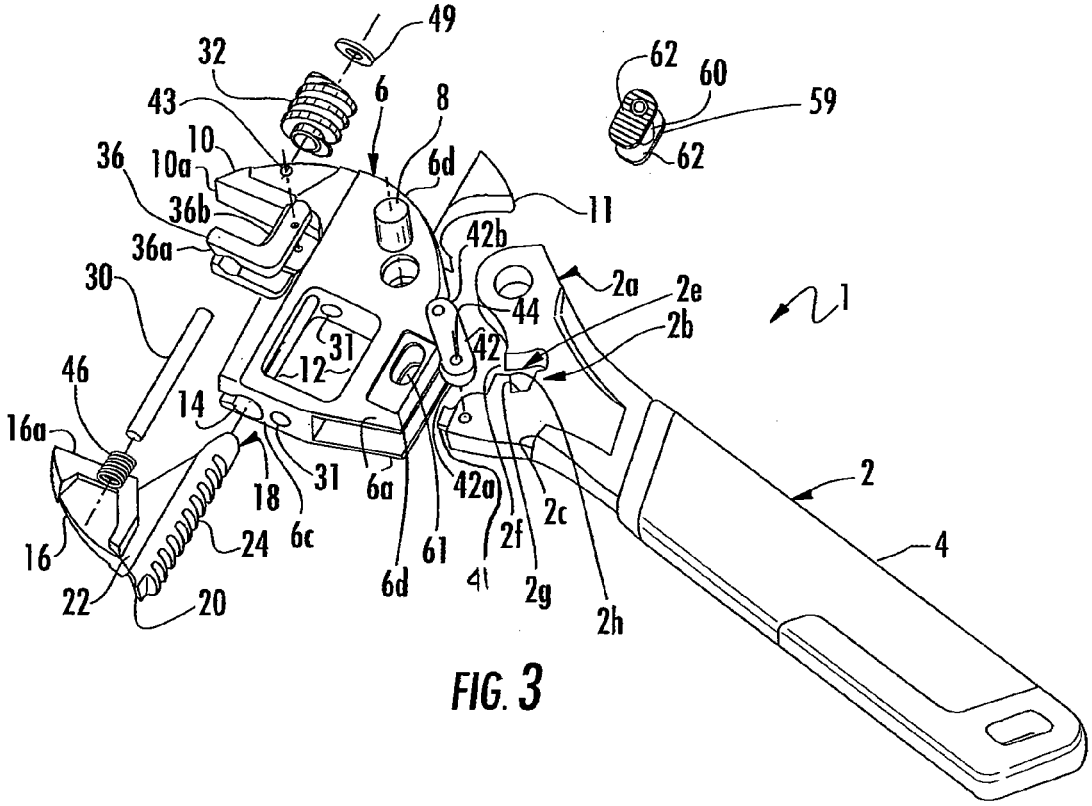
FIG. 3 is an exploded view of the wrench of FIG. 1.

The wrench of the invention is shown generally at 1 in FIGS. 1 through 9 and consists of a rigid handle portion 2 that is dimensioned to be gripped by a user. The handle may include an overmolded plastic sleeve 4 for increased comfort. A body portion 6 is pivotably supported on the handle portion 2 by pivot pin 8 such that the body portion 6 can pivot relative to the handle 2 about pin 8. The body portion 6 and handle portion 2 may be formed of forged steel or other rigid high strength material. A fixed jaw 10 is rigidly and fixedly supported on body portion 6 and may be formed integrally therewith. As best shown in FIG. 3, body portion 6 comprises two parallel flanges 6*a* that define a space there between. Handle 2 terminates in a connecting portion 2*a* that is dimensioned to fit between the flanges 6*a*. Connecting portion 2*a* also includes a recess 2*b* that forms a part of a ratchet locking mechanism as will hereinafter be described.

A spring 11 is located between connecting portion 2*a* of handle 2 and body portion 6 in the space defined by flanges 6*a*. Spring 11 may be an elastomer spring (as shown), a wave spring, a compression spring, a torsion spring or any other suitable spring. Spring 11 applies a force that tends to maintain the angular relationship between the handle 2 and body portion 6 in the position shown in FIG. 6. In this position flanges 6*a* of body portion 6 are spaced slightly from abutment surfaces 2*c* formed on handle 2 to create gap G. The handle 2 can be pivoted relative to the body portion between the fully closed position (shown in FIG. 7) where the flanges 6*a* abut the abutment surfaces 2*c* to the fully open position (shown in FIG. 9) where the flanges 6*a* are at a maximum distance from abutment surfaces 2*c*. In the fully open position of FIG. 9 spring 11 is compressed between the connecting portion 2*a* of handle 2 and the body portion 6 such that when the force on the handle is removed, spring 11 will return the wrench to the position of FIG. 6.

The fixed jaw 10 includes a jaw face 10*a* that contacts a workpiece when the wrench is in operation. As used herein a workpiece may include any device, member or fastener to be gripped by wrench 1. Typically, the workpiece will comprise a fastener such as a bolt, nut or fitting or the like to which a torque is to be applied.

The body portion 6 includes a cavity 12 formed therein that in one embodiment extends completely through body portion 6. The body portion 6 also includes an elongated passageway 14 that extends into the body portion 6 from side face 6*c* to under the fixed jaw 10. In one embodiment the passageway 14 extends through the body portion 6 to side face 6*d* such that the passageway is open at both sides of the body portion. The passageway 14 is open along its upper edge so as to be able to receive movable jaw 16. Passageway 14 also communicates with cavity 12 such that an opening is created between the cavity 12 and the passageway 14.

A movable jaw 16 is mounted on body portion 6 such that it can reciprocate towards and away from fixed jaw 10. Jaw 16 includes a jaw face 16*a* that is opposed to and faces jaw face 10*a* of fixed jaw 10. A workpiece can be gripped between jaw face 10*a* and jaw face 16*a* as will hereinafter be described. Movable jaw 16 includes a flange 18 that is slidably received in passageway 14 such that the movable jaw can reciprocate relative to body portion 6 but cannot be removed from passageway 14. Passageway 14 is disposed such that movable jaw 16 moves substantially perpendicular to jaw face 10*a* toward and away from fixed jaw 10. One mechanism for providing such a connection is to make the flange 18 having a cross-sectional shape where a enlarged rail portion 20 is connected to the movable jaw via a narrower neck portion 22. Passageway 14 has a similar, though slightly larger, cross-section shape such that the flange 20 can slide in passageway 14 but cannot be separated from the body portion 6. A stop may be provided to prevent the movable jaw from sliding all of the way out of passageway 14. A series of teeth 24 are formed on the flange 18 to form a rack that extends from passageway 14 and into cavity 12.

A shaft 30 is fixed within cavity 12. Shaft 30 is disposed with its longitudinal axis disposed parallel to the direction of travel of movable jaw 16. The opposite ends of shaft 30 are supported in cavities 31 formed in body portion 6. A knurled screw 32 is rotatably mounted on shaft 30 for rotation relative thereto. Screw 32 can also reciprocate relative to shaft 30 along the longitudinal axis of the shaft. Screw 32 engages teeth 24 of flange 18 such that the rotation of screw 32 results in the translation of movable jaw 16 towards and away from fixed jaw 10.

Also mounted on shaft 30 is cassette 36. Specifically, cassette 36 includes a first arm 36*a* that has an aperture that slidably receives shaft 30 such that cassette 36 can reciprocate relative to shaft 30 along the longitudinal axis of shaft 30. A spring 46 biases the cassette in the direction of arrow A (FIG. 2). In one embodiment spring 46 comprises a compression spring that is located over shaft 30 between cassette 36 and an inside surface of cavity 12. A compression spring 49 is also located between screw 32 and the opposite side of cavity 12 to maintain proper spacing between the movable and fixed jaws in the neutral position. Compression spring 49 has a relatively small displacement and a relatively high spring force and may comprise a rubber compression washer (as shown), a wave spring, a compression spring, a torsion spring, an elastomer spring or the like. Spring 49 also allows the jaws of the invention to tightly clamp the workpiece as will hereinafter be described Screw 32 and cassette 36 can reciprocate as a unit on shaft 30 in the direction of movement of movable jaw 10.

A link 42 has a first end 42*a* pivotably mounted on handle portion 2 at pivot pin 44. Link 42 is disposed such that its pivot axis is parallel to pivot pin 8. Link 42 is arranged such that its other end 42*b* extends into cavity 12 and is pivotably connected to second arm 36*b* of cassette 36 at pivot pin 43. Link 42 forms part of an over-center locking mechanism that locks the movable jaw 16 in position during operation of the wrench and prevents back drive.

Back drive describes the forces acting on the wrench when the wrench applies a large gripping force to a workpiece as the wrench is torqued. When a gripping force is applied by opposed jaw faces 10*a* and 16*a* on a workpiece, the workpiece generates an opposing force on the jaws tending to separate the jaws (back drive). As the torque applied by the wrench increases the back drive forces increase. In existing ratcheting adjustable wrenches, at high torques, the backdrive forces are large enough that they can cause the ratcheting mechanism to be overpowered thereby forcing the jaws apart. When the jaws are forced apart the wrench will slip on the workpiece such that the amount of torque that can be applied to the workpiece is limited. The locking mechanism of the invention is designed such that the back drive force locks the movable jaw in position such that the pliers of the invention can generate high torque.

Figure 4:
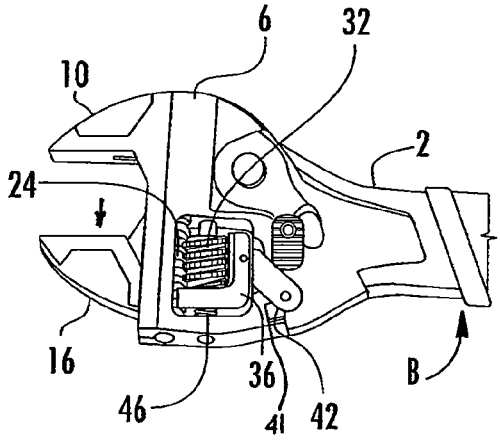
FIGS. 4 and 5 are partial cut-away views showing the operation of the ratcheting and locking mechanism of the wrench of FIG. 1.
Figure 5:
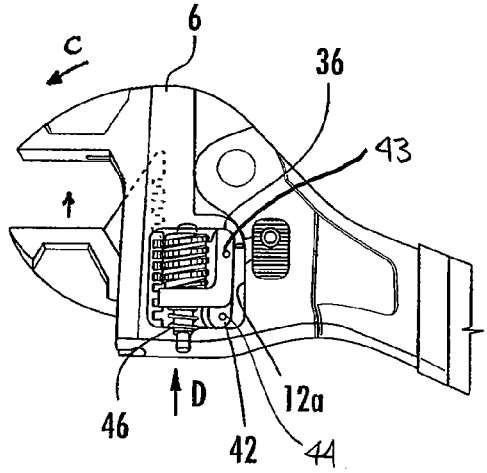
Figure 6:
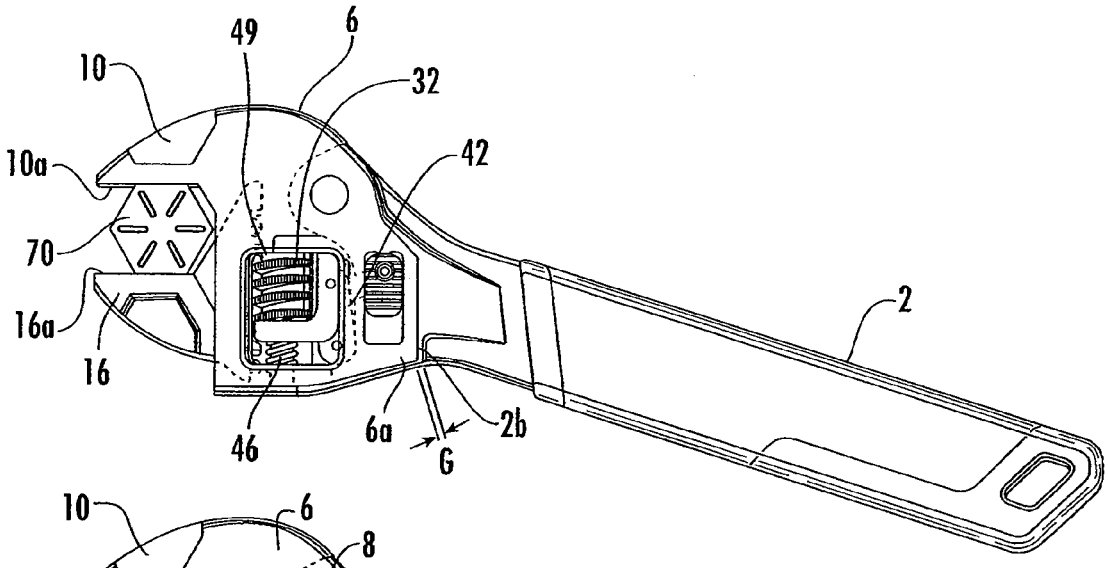
FIGS. 6 through 9 are side views showing the operation of the wrench of FIG. 1.

Referring to FIGS. 4 and 5 the operation of the over-center locking mechanism will be described. FIG. 4 shows the locking mechanism when the wrench is in the ratcheting position. The "ratcheting position" is the position where movable jaw 16 is not locked in position and the jaws 10 and 16 are able to spread and move over a workpiece. Used on a standard right hand thread fastener, the wrench assumes the ratcheting position when handle 2 is rotated counter-clockwise in the direction of arrow B (the loosening direction). (It is to be understood that the wrench of the invention can be used on left hand threads or to loosen right hand threads simply by turning the wrench over relative to the workpiece.) In this position, body portion 6 is pivoted away from handle 2 (clockwise as viewed in FIG. 5), link 42 is pivoted to a release or unlocked position and cassette 36 is forced against and compresses spring 46. Because cassette 36 is connected to movable jaw 16 via the engagement of screw 32 with teeth 24, the movable jaw 16 also moves slightly away from fixed jaw 10. Further rotation of handle 2 causes the body portion 6 to rotate relative to the workpiece 70. Because the link 42 is in the unlocked position, as the body portion 6 turns relative to the workpiece, the workpiece turns between jaws 10 and 16 and creates a force that moves jaw 16 away from jaw 10. As jaw 16 moves away from jaw 10 enough space is created between the jaws to allow the jaws to slip over the workpiece creating a ratcheting action.

Once the jaws clear the high points of a work piece, the spring 11 causes the body portion 6 to rotate relative to the handle 2 in the direction of arrow C as shown in FIG. 5. Body portion 6 is pivoted relative to handle 2 until flanges 6*a* contact abutment surfaces 2*c*. As the body portion 6 pivots relative to the handle 2, link 42 is pivoted toward the locked position. As the link 42 rotates to the locked position it drives cassette 36 in the direction of arrow D forcing movable jaw 16 to close on the workpiece. As the handle 2 is torqued clockwise as viewed in FIG. 5, the link 42 pivots to the over-center position and the jaw 16 is forced toward jaw 10 to tightly clamp the workpiece 70 therebetween.

In the position shown in FIGS. 2 and 5 with the jaws gripping the work piece, link 42 is arranged with its longitudinal axis, defined as a line passing through the center of pins 43 and 44, in an over-center position. In the over-center position the longitudinal axis of the link 42 extends at a small angle relative to the direction of motion A where the distal end 42*b* is farther away from the shaft 30 than the proximate end 42*a* of the link 42. Link 42, when in the over-center position, abuts the leg 36*b* of cassette 36 such that the amount of over-center rotation is limited. In the over center position link 42 opposes the backdrive force. Link 42 cannot inadvertently move to the release position of FIG. 4 where the jaws may inadvertently open because the back drive force transmitted to link 42 maintains the link in the overcenter position. The greater the backdrive force applied to the jaws, the greater the force applied to link 42. Because link 42 is in an over-center position, increasing the force applied to the link actually locks the link more firmly in the over-center position. The back drive force is transmitted from the link 42 directly to the body portion 6. The benefits of the over-center lock will also be achieved with a dead-center configuration where the longitudinal axis of link 42 is parallel to the direction of motion A. While a dead center orientation of link 42 maximizes the force exerted on the workpiece by the jaws, in practice the link will typically assume a slight over-center position to ensure that the link does not inadvertently assume an under-center orientation.

In certain applications the user may not want to use the ratchet feature. Referring to FIG. 3 a latch 59 is provided to prevent the wrench from ratcheting such that the wrench may be used as a standard adjustable wrench. Latch 59 comprises a rod 60 that is inserted through aligned slotted apertures 61 in flanges 6*a*. When the wrench is in the rest position shown in FIG. 6 the rod 60 also is disposed in recess 2*b* formed in connecting portion 2*a*. Actuating members 62 are fixed to either end of rod 60. Actuating members 62 sit in recesses 6*d* formed in body portion 6 and retain the rod in the body portion 6. Actuating members 62 also provide an area to be gripped by the end user for manipulating the latch. Rod 60 can be moved from an unlocked position to a locked position. In the unlocked position the rod rests in recess 2*b* in area 2*e* directly opposite the recess opening 2*f*. When handle 2 is rotated counterclockwise, rod 60 moves out of recess 2*d* through opening 2*f* allowing the ratcheting action to take place. In the locked position rod 60 rests in recess 2*d* in area 2*g* where finger 2*h* prevents the rod from moving out of recess 2*d*. When handle 2 is rotated counterclockwise, the engagement of rod 60 with finger 2*h* prevents the body portion 6 from rotating relative to handle 2 such that the handle and body portion operate like a traditional adjustable wrench.

Operation of the wrench of the invention will be described with specific reference to FIGS. 6 through 9. In the neutral state with no external forces acting on the wrench, wrench 1 assumes the orientation shown in FIG. 6 where a small gap G is maintained between flanges 6*a* and abutment surfaces 2*b*. In this position link 42 is pivoted away from the dead/over-center position by about 4 degrees. The distance between the fixed jaw 10 and movable jaw 16 may be adjusted by rotating screw 32 to move movable jaw towards or away from the fixed jaw. The spacing between the jaws is adjusted to accommodate the workpiece 70. The workpiece is placed between the movable jaw 16 and fixed jaw 10 and the screw 32 is rotated until the jaw faces 16*a* and 10*a* contact the workpiece 70.

Figure 7:
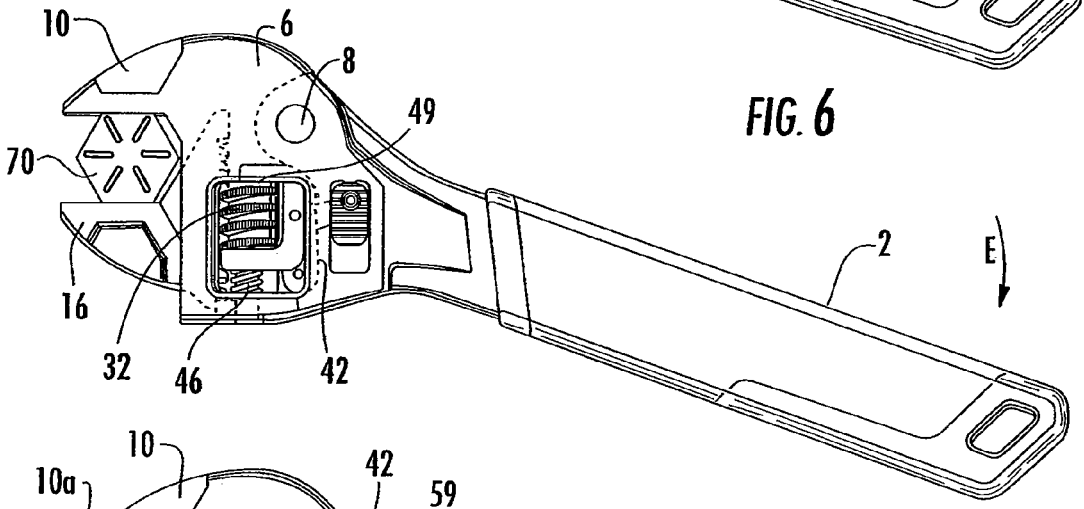

To apply a tightening torque to the workpiece 70, the handle is rotated clockwise in the direction of arrow E as shown in FIG. 7. As the handle 2 is rotated in the direction of arrow E, the handle 2 pivots relative to the body portion 6 about pivot pin 8 closing gap G. When the handle 2 pivots relative to the body portion 6, the link 42 pivots clockwise from the neutral position shown in FIG. 6 to the dead/over-center position shown in FIG. 7. As the link 42 pivots it forces cassette 36 and screw 32 toward fixed jaw 10. Because of the engagement of screw 32 with teeth 24, movable jaw 16 is also moved toward fixed jaw 10. Compression spring 49, located between screw 32 and the inside surface of cavity 12, is compressed by screw 32 allowing cassette 36 and movable jaw 16 to move slightly towards fixed jaw 10 such that the workpiece is tightly gripped between the jaws. It is to be understood that as the torque is increased and link 42 is moved to the dead/over-center position, the jaws, cassette 36, and link 42 may all deflect or deform slightly thereby increasing the gripping force on the work piece. This deflection also allows the link to move to the over center position. The workpiece may also be slightly deformed from the pressure created by the jaws depending on the relative hardness of the workpiece. The wrench assumes the fully torqued position shown in FIG. 7. In this position the movable jaw 16 is fully closed on the workpiece 70 thereby trapping the workpiece between the movable jaw 16 and fixed jaw 10. Link 42 is in the over-center position locking the movable jaw 16 in position and preventing the movable jaw from spreading away from the fixed jaw 10 due to back drive. As increasing torque is applied to the wrench 1 the back drive force that is applied to link 42 serves to maintain link 42 in the locked overcenter position. A projection 41 may be provided on connecting portion 2*a* of handle 2. Projection 41 is dimensioned so as to abut the cassette 36 when the link 42 is in the locked position. The engagement of projection 41 with cassette 36 transmits the forces acting on the cassette 36 to handle 2 as increasing torque is applied to the wrench. The projection 41 serves to reinforce the cassette 36.

Figure 8:
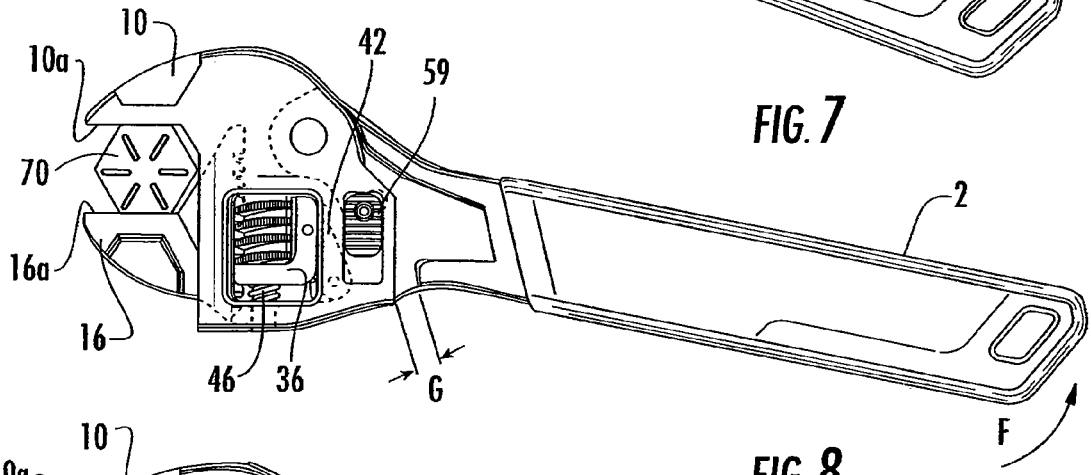
Figure 9:
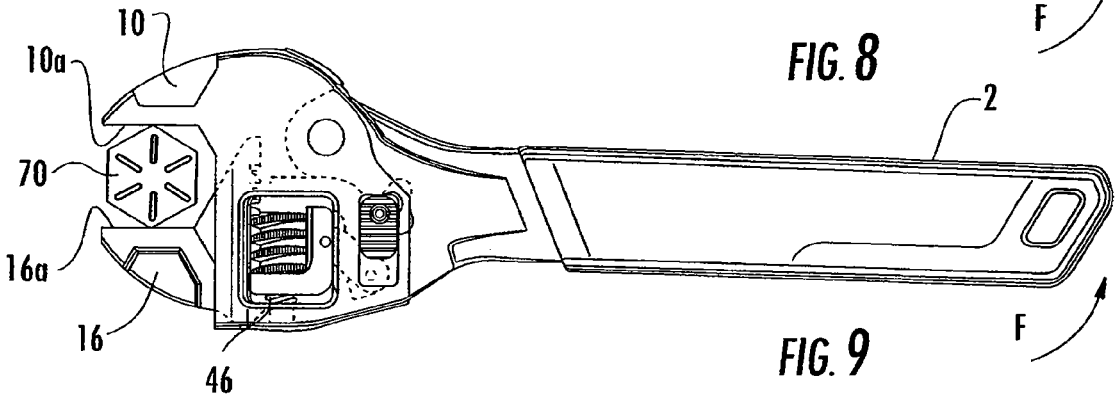
Figure 10:
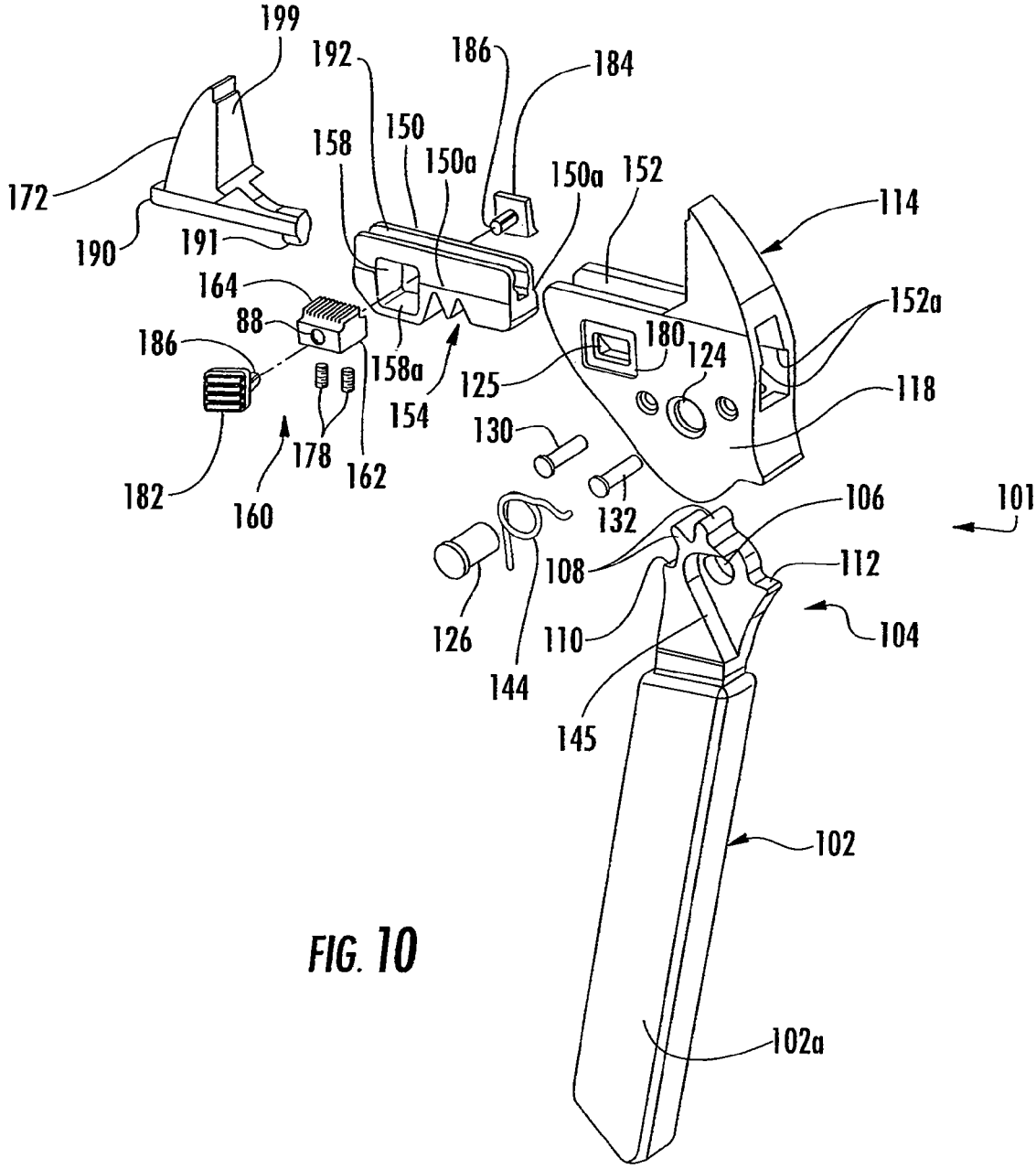
FIG. 10 is an exploded perspective view of another embodiment of the wrench of the invention.

To use the ratcheting function of the wrench, latch 59 is unlocked. Handle 2 is rotated counterclockwise in the direction of arrow F as shown in FIG. 8. As the handle 2 is rotated in the direction of arrow F, handle 2 pivots relative to body portion 6 such that the gap G increases. As the handle 2 pivots away from body portion 6, link 42 rotates to the open position shown in FIG. 8. As link 42 rotates it pulls cassette 36 away from fixed jaw 10. The cassette 36 pulls movable jaw 16 away from fixed jaw 10. As the handle is rotated further in the direction of arrow F, as shown in FIG. 9, the force exerted by the workpiece 70 on the jaws forces movable jaw 16 away from fixed jaw 10. This movement continues until the space between the jaws is wide enough to allow the wrench to slip over the surface of workpiece 70 without applying torque thereto. Wrench 1 is rotated in the direction of arrow F until it reaches a position relative to the workpiece 70 desired by the user. Rotation of the wrench is then reversed, such that handle 2 is moved in the direction of arrow E. When handle 2 is rotated in the direction of arrow E, it locks onto the workpiece as previously described with respect to FIGS. 6 and 7 such that the jaws clamp the workpiece and torque can be applied to the workpiece. These steps are repeated until the workpiece is suitably torqued.

The wrench of the invention is adjustable in that the space between the jaws can be made larger or smaller using screw 32 such that it accepts a wide range of workpiece sizes. The wrench also provides a ratcheting function such that the wrench can apply multiple turns to the workpiece without being removed from the workpiece. The use of the dead/over-center locking mechanism allows high torque to be applied to the wrench while still providing the adjustability and ratcheting functions. The latch 59 can also be used to convert the ratcheting adjustable wrench into a traditional non-ratcheting adjustable wrench.

An alternative embodiment of the wrench of the invention is shown generally at 101 in FIGS. 10 through 18 and includes a handle 102 having a first portion 102*a* that is to be gripped by the user. Connecting portion 104 of handle 102 is formed with a through hole 106 extending through the handle. Gear teeth 108 extend from the connecting portion 104 substantially radially from through hole 106. In the illustrated embodiment two such teeth are provided although a greater or lesser number of teeth may be provided if desired. Connecting portion 104 is also provided with shoulders 110 and 112 that act as stops as will hereinafter be described.

Figure 11:
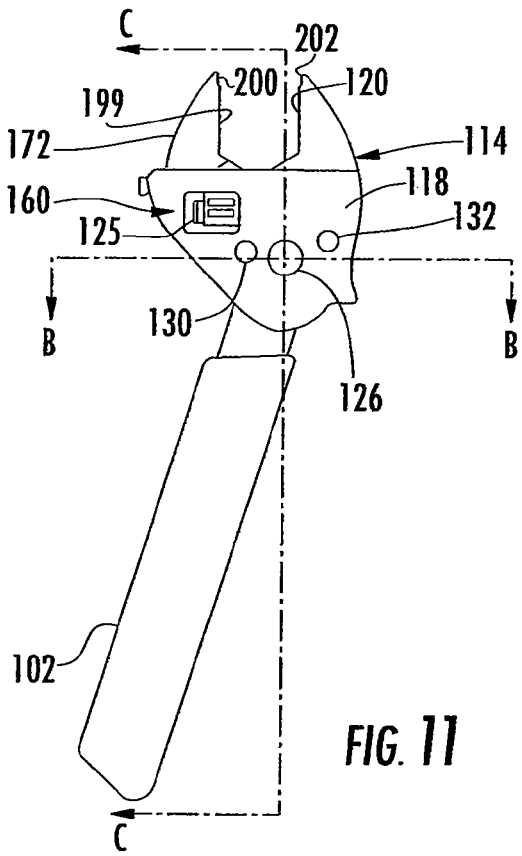
FIG. 11 is a front view of the wrench shown in FIG. 10.

A body portion 118 has a fixed jaw 114 formed thereon where jaw 114 includes a working surface or jaw face 120 for engaging an article to be gripped. Body portion 118 defines a cavity 122 (FIG. 13) for receiving the connecting portion 104 of handle 102. The side walls of body portion 118 that define cavity 122 also define aligned apertures 124. When end 104 of handle 102 is disposed in cavity 122, the apertures 124 are aligned with through hole 106. A pivot pin 126 is inserted through apertures 124 and through hole 106 to connect body portion 118 to handle 102 such that fixed jaw 114 can pivot relative to handle 102 about pivot pin 126. Located within cavity 122 are stops 130 and 132 that may be pins extending from the inside of side wall of body portion 118 into cavity 122, as best shown in FIG. 11. Stops 130 and 132 are engaged by shoulders 110 and 112 to limit the range of rotation of fixed jaw 114 relative to handle 110.

A second through hole 125 is formed in body portion 118 for receiving locking mechanism 160. Through hole 125 is dimensioned such that the locking mechanism can reciprocate in through hole 125 in both the directions of arrow B' and arrow D' (FIG. 15) as will hereinafter be described.

Figure 15:
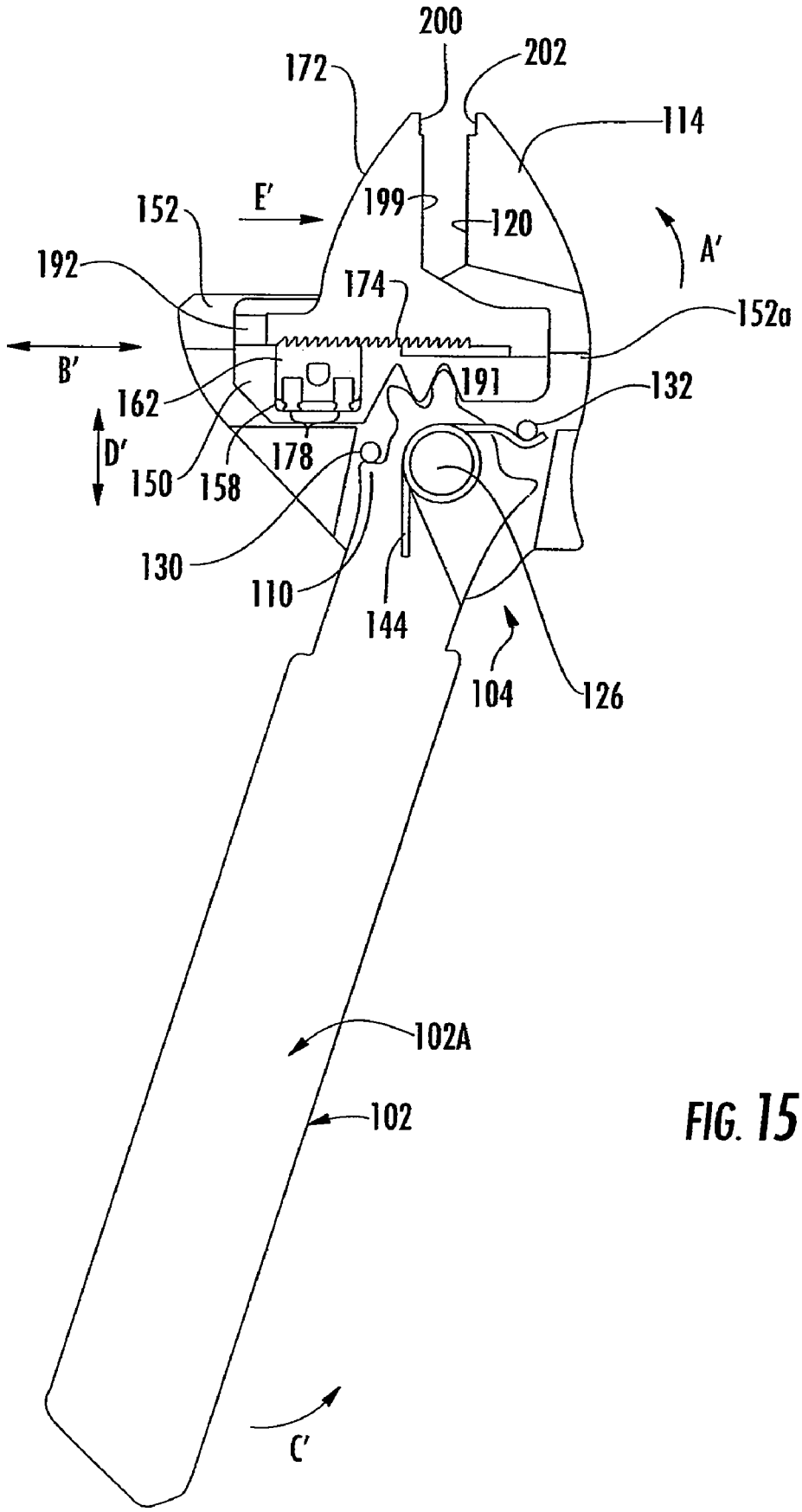
FIG. 15 is a cut-away front view of the wrench shown in FIG. 10.
Figure 16:
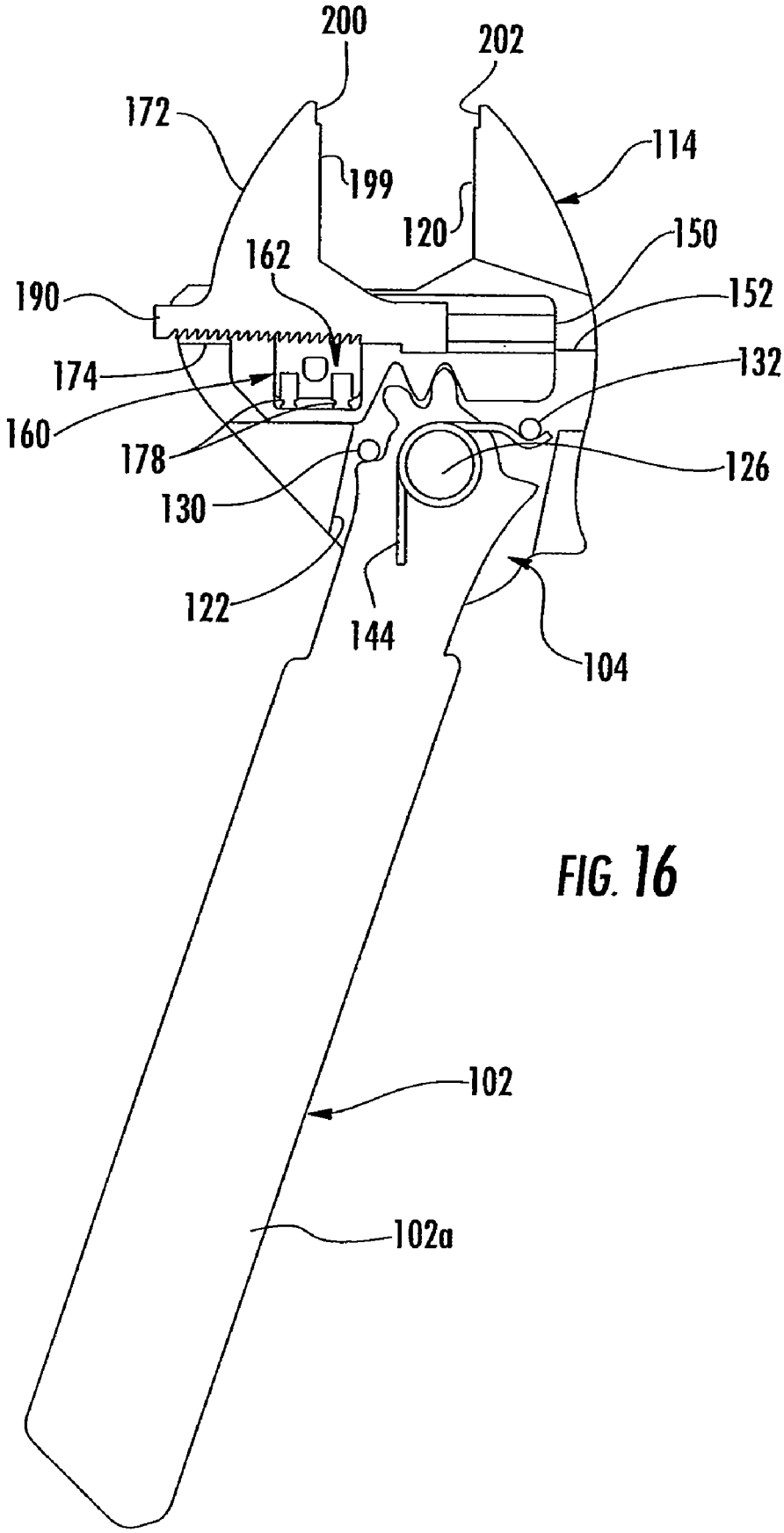
FIG. 16 is a cut-away front view of one embodiment of the wrench of the invention similar to FIG. 15 showing the jaws spaced further apart.

A torsion spring 144 is disposed around pivot pin 126 such that one end contacts handle 110 and the other end contacts stop 132. A shoulder 145 is formed on the connecting portion 104 of handle 102 against which the spring 144 exerts the force. Spring 144 is biased such that the spring exerts a force on first body portion 118 tending to rotate the body portion about pivot pin 126 in the direction of arrow A' (FIG. 15). Spring 144 rotates body portion 118 relative to handle 110 until stop 130 contacts shoulder 110 as shown in FIG. 15.

A ratchet bar 150 is slidably received in a passage 152 formed in body portion 118 such that ratchet bar 150 can slide in passage 152 in the direction of arrow B' (FIG. 15). Ratchet bar 150 includes teeth or receptacles 154 for matingly engaging teeth 108 of handle 110. Teeth 108 engage teeth 154 such that when handle 110 is pivoted relative to body portion 118 in the direction of arrow C' (FIG. 15), ratchet bar 150 will be translated slightly to the left as viewed in FIG. 15 to slightly open the jaws. Ratchet bar 150 is also formed with a shoulder 150*a* on either side thereof. The shoulders 150*a* engage ledges 152*a* formed on the interior of passage 152 to retain the ratchet bar 150 in the body portion 118 but to allow the ratchet bar to reciprocate relative to the body portion and fixed jaw 114 as represented by arrow B'.

Ratchet bar 150 defines a through hole 158 for receiving locking mechanism 160 (see FIG. 10) where locking mechanism 160 includes a block 162 having a plurality of teeth 164 formed thereon. Block 162 is slidably located in through hole 158 such that it can reciprocate in through hole 158. Specifically, block 162 can move in the direction represented by arrow D' that is perpendicular to the direction of movement of movable jaw 172 (represented by arrow B'). Block 162 includes teeth 164 at the upper surface thereof that are dimensioned to mate with teeth 174 formed on movable jaw 172. The engagement of teeth 164 with teeth 174 lock the movable jaw 172 in the desired position and prevent it from moving away from fixed jaw 114. The back face of the teeth 164 and 174 are shaped such that the teeth act like camming surfaces to push the block 162 away from ratchet bar 150 and disengage the teeth when the jaw 172 is moved in the direction of arrow E' (FIG. 15). Thus, even when the teeth 164 and 174 are engaged a force applied to movable jaw 172 in the direction of arrow E' will close the jaws. Thus, a user can close the jaws simply by pushing on movable jaw 172 with a thumb or finger without the user manually disengaging locking mechanism 160. A pair of compression springs 178 are located between block 162 and the face 158*a* of through hole 158 that bias the block 162 towards ratchet bar 150 such that teeth 164 are normally biased into engagement with teeth 174.

The spacing between the jaws 114 and 172 is increased by first depressing actuator button 182 or 184 to disengage the teeth 164 of block 162 from the teeth 174 of movable jaw 172. Movable jaw 172 can then be moved away from jaw 114 by pushing jaw 172 with a thumb or finger. Actuator button 182 or 184 is then released allowing teeth 164 to engage teeth 174. The jaws are closed by pushing on movable jaw 172. Because the teeth are ratcheting teeth the jaws can be closed without the need to manually disengage the teeth using actuator buttons 182 or 184. The engagement of teeth 164 with teeth 174 prevent the jaws from spreading.

Cover plate/actuator button 182 is located on one side of fixed jaw 114 and a second cover plate/actuator button 184 is located on the opposite side of fixed jaw 114. The cover plate/actuator buttons are dimensioned such that they extend the height of through hole 125 whether the block 162 is in the extended position with the teeth engaged or in the retracted position with the teeth disengaged. The cover plate/actuator buttons 182 and 184 are dimensioned such that they do not extend the entire width of the through hole 125 to allow the block to move in through hole 158 as will hereinafter be described. The cover plate/actuator buttons are connected to block 162 such as by posts 186 that extend from the cover plate/actuator buttons and are press fit into bores 188 formed in block 162. Other mechanisms may be used to connect the cover plate/actuator buttons 182 and 184 to the block 162 such as rivets, screws, adhesive, welding or the like. Moreover, one of cover plate/actuator buttons 182 or 184 may be made integrally with block 162. A recess 180 may be formed in the external side faces of fixed jaw 114 surrounding through hole 125 to receive the cover plate/actuator buttons to minimize the extent they protrude from the device.

Figure 12:
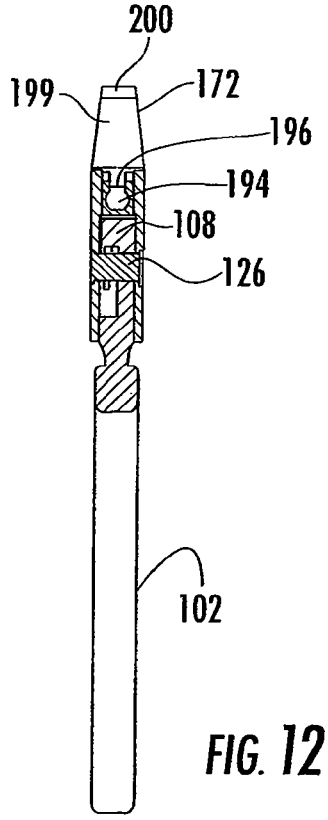
FIG. 12 is a section view taken along line C-C of FIG. 11.
Figure 13:
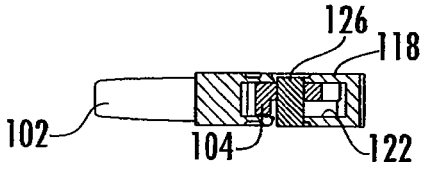
FIG. 13 is a section view taken along line B-B of FIG. 11.
Figure 14:
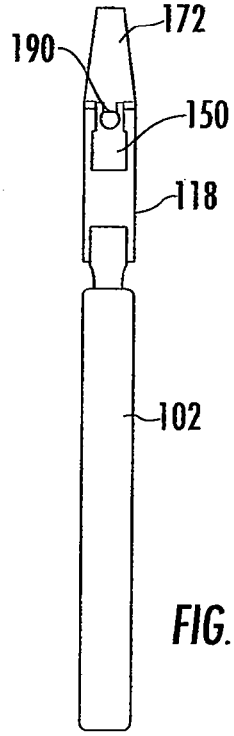
FIG. 14 is a side view of the wrench shown in FIG. 10.

Ratchet bar 150 also includes a channel 192 extending along the length thereof and dimensioned to receive the flange 190 of movable jaw 172. Flange 190 and channel 192 are dimensioned and shaped such that the flange can slide in the channel. In one embodiment flange 190 in transverse cross-section is formed such that it has an enlarged portion 194 that is connected to jaw 172 by a relatively narrower neck portion 196 (FIG. 12). Channel 192 has a mating transverse cross-section such that once the flange is slid into channel 192 it can slide in the channel in the direction of arrow B' but cannot be separated from the channel.

While teeth 174 on flange 190 and teeth 164 on block 162 are shown in planes that are parallel to the direction of movement of jaw 172 (represented by arrow B') it may be desirable to make these planes at an oblique angle with respect to the direction of movement of jaw 172. These planes are preferably arranged at an angle of less than 10 degrees with respect to the direction of movement of jaw 172. The distance between the teeth and the number of teeth used may be selected such that the spacing between jaws 114 and 172 corresponds to standard English or metric units or other desired dimensions.

Movable jaw 172 includes a working surface or face 199 that is opposed to the working surface 120 of fixed jaw 114. Surfaces 199 and 120 are formed with a recessed surfaces 200 and 202, respectively, at the distal ends thereof thereof that are used to size the wrench to the article to be gripped as will hereinafter be described. While faces 120 and 199 are shown as generally planar surfaces it will be appreciated that these faces may have other shapes or configurations depending on the specific function of the wrench and the shape of the article being gripped. For example faces 120 and 199 may be formed with gripping ridges or may be comprised of multiple surfaces disposed at angles relative to one another.

Operation of the device will now be described. It is to be understood that the wrench of the invention may be used to grip any article including but not limited to nuts, bolts, pipes, pipe fittings or the like and the wrench has utility in any application that requires the administration of torque to an article.

The first step is to size the space between the jaws 114 and 172 the proper distance. This can be accomplished one of two ways. In one manner of operation, the user positions the article to be gripped between the recessed surfaces 200 and 202 and closes the jaws until the article is gripped between the recessed surfaces. As will be understood because surfaces 200 and 202 are recessed from working faces 120 and 199, the working faces 120 and 199 will actually be spaced from one another a distance that is slightly less than the width of the article being gripped. This is to ensure the proper action of the ratcheting mechanism.

Once the jaws are spaced the proper distance from one another, the wrench is fit on the article such that article is located between jaws 172 and 114 with working faces 120 and 199 contact the article. Even though the space between jaws 172 and 114 is initially sized such that it is less (by the combined depths of recessed surfaces 200 and 202) than the size of the article, the article can be fit between the jaws because of the action of the ratchet bar. Specifically, when handle 110 is turned in the direction of arrow C' (this is the direction that would loosen a standard right hand threaded member) handle 110 pivots slightly around pivot pin 126 such that teeth 108 engage the mating teeth 154 on ratchet bar 158 to move ratchet bar 150 slightly to the left as viewed in the figures (best shown in FIG. 17). This movement slightly increases the space between the working surfaces 120 and 199 of the jaws to allow the article to fit between the jaws. The larger space between the jaws when handle 110 is in the loosening position of FIG. 17 can be compared to the smaller space between the jaws when handle 110 is biased to the normal tightening position by spring 144 (best shown in FIG. 18).

Figure 17:
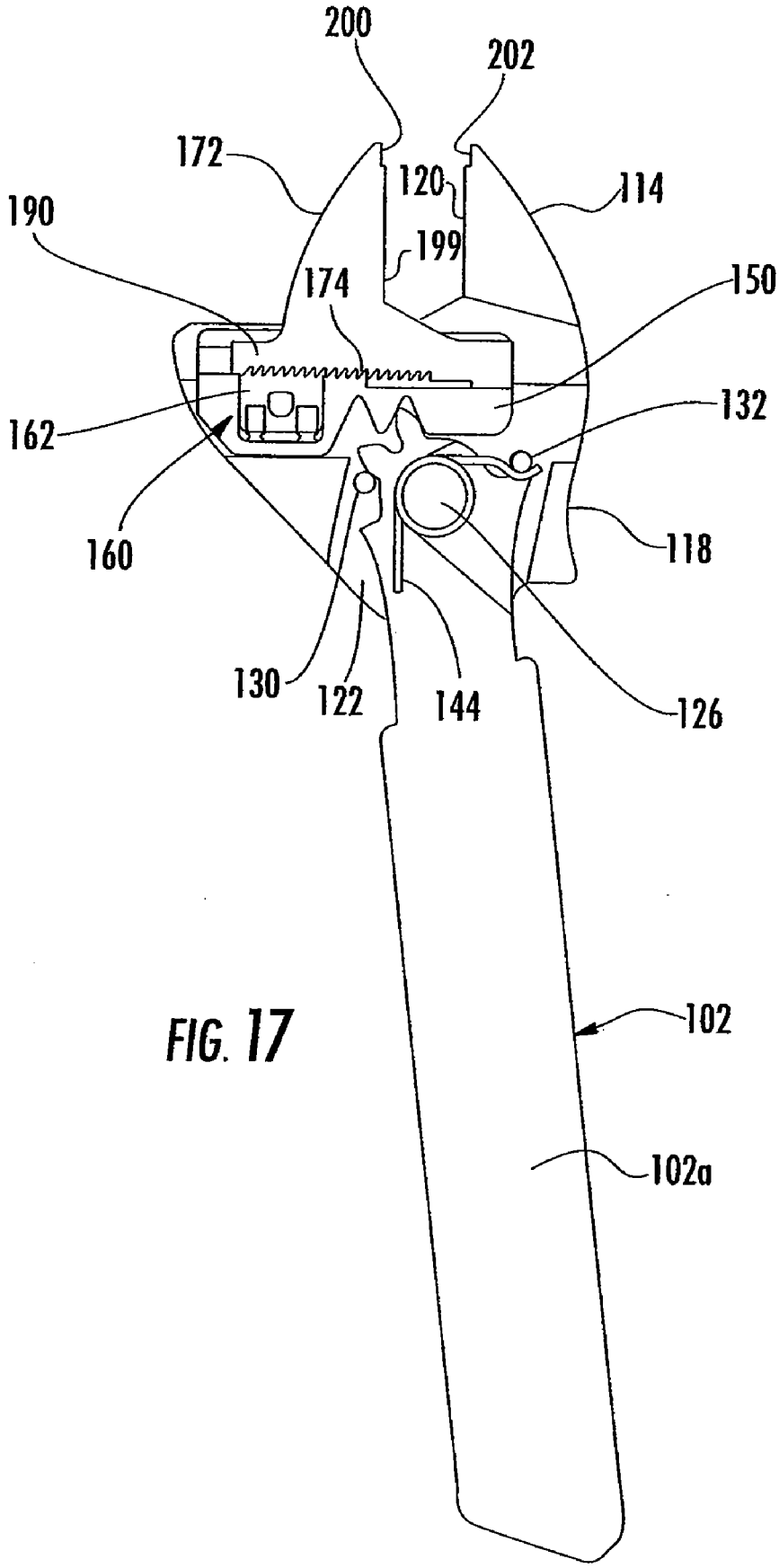
FIG. 17 is a cut-away front view of one embodiment of the wrench of the invention similar to FIG. 16 showing the handle in a loosening orientation.
Figure 18:
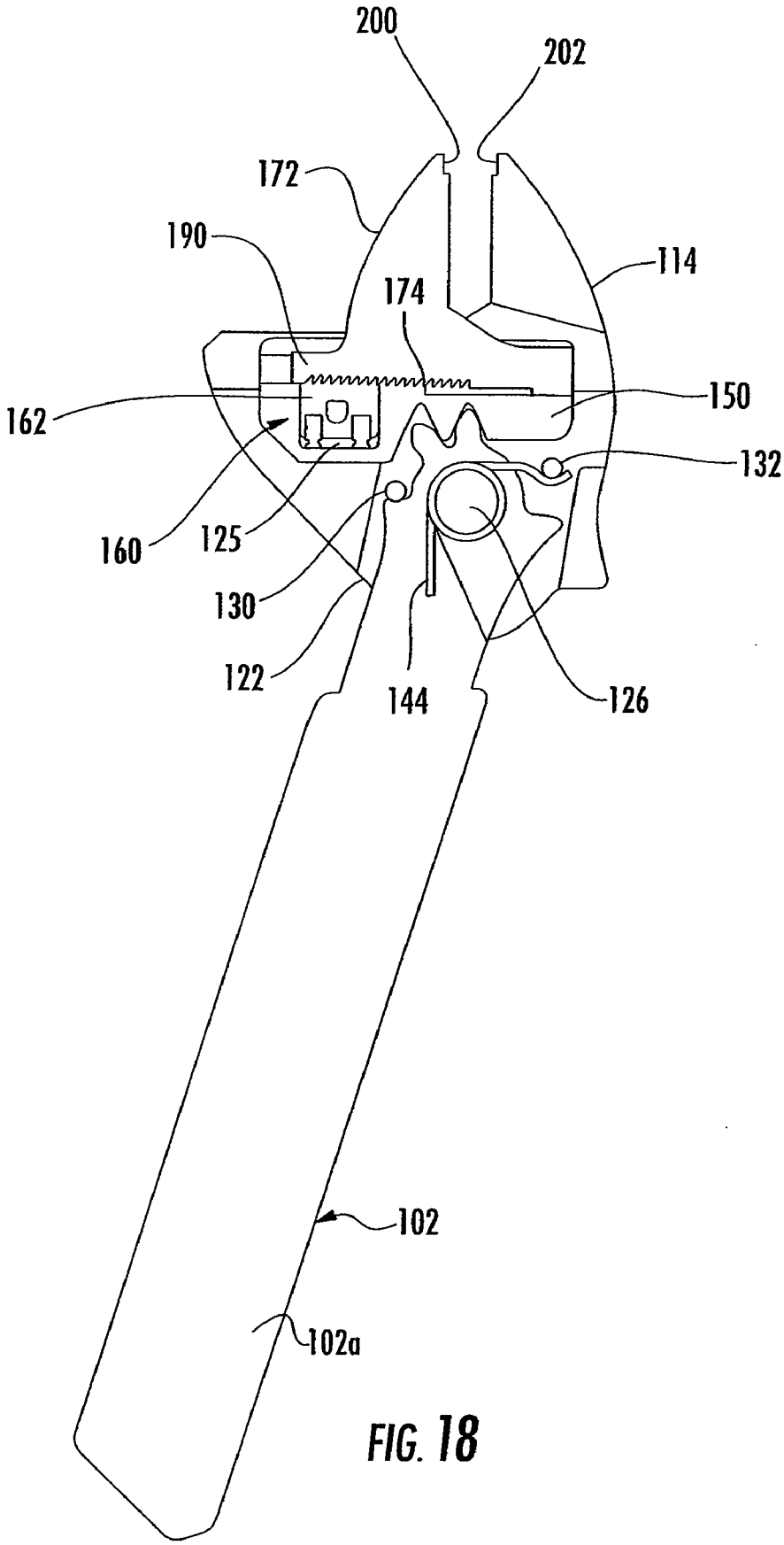
FIG. 18 is a cut-away front view of one embodiment of the wrench of the invention similar to FIG. 17 showing the handle in a tightening orientation.

Also, the reciprocation of locking mechanism 160 is also shown in FIG. 18 where locking mechanism 160 is positioned slightly to the left in the loosening position of FIG. 17. This reciprocation is due to the slight reciprocation of ratchet bar 150, jaw member 172 and locking mechanism 160 as handle 110 is moved between the tightening and loosening positions. As previously explained through hole 125 is dimensioned to account for this movement.

Once the article is positioned between the jaws 114 and 172 with working surfaces 120 and 199 engaging the article, the wrench can operate with a ratcheting action such that the article can be tightened (or loosened if the wrench is turned over) without removing the wrench from the article. As a tightening force is applied to the handle 110 (rotation opposite arrow C') the engagement of teeth 108 with the teeth 154 on the ratchet bar 150 applies a force that tends to move the ratchet bar together with the movable jaw 172 towards the jaw 114 thereby increasing the pressure on the article from the jaws as the tightening force is applied. As more force is applied, the pressure on the article increases such that the grip on the article becomes greater. Moreover, as the tightening force is applied, ratchet bar 150 will pivot slightly within passage 150 under the force applied by handle 110. As the ratchet bar 150 pivots shoulders **150*a* are pressed into engagement with ledges 152*a*. The contact between ledges 152*a* and shoulders 150*a* bind the ratchet bar 150 to the body portion 118 such that the ratchet bar 150 cannot move. This binding contact ensures that the body portion 118 will not inadvertently pivot open (i.e. rotate clockwise as viewed in FIG. 18) due to the reactive back-drive force from the article being gripped when a large force is applied by handle 110. Because the ratchet bar 150 undergoes this slight pivoting movement in passage 152, it may be desirable to bias either face 120 or face 199 such that the faces are parallel to one another when ratchet bar 150** pivots such that the faces are parallel when gripping an article is gripped.

To use the ratcheting action the rotation of handle 110 is reversed such that the handle is rotated slightly in the loosening direction (direction of arrow C') such that the force applied by handle 110 on ratchet bar 150 is reversed and the ratchet bar 150 movable jaw 172 are moved slightly away from jaw 114. As the space between the jaws increases, the jaws are able to slip around the article without applying a loosening force to the article. Once the handle 110 is repositioned, a tightening force opposite arrow C' is again applied causing the jaws to close on the article as previously described. The tightening and ratcheting movement of handle 110 can be quickly applied.

The second method for properly spacing the jaws uses the ratcheting action of the wrench. The jaws are closed on the article with working faces 199 and 120 in contact with the article. Recessed faces 200 and 202 are not used. Once positioned between the working faces, handle 110 is rotated in the direction of arrow C' such that ratcheting bar 150 spreads the jaws as previously described. This creates a gap between the moveable jaw 172 and the article. The user then closes the moveable jaw slightly by simply pressing the moveable jaw 172 to create the proper spacing between the jaws.

Figure 19:
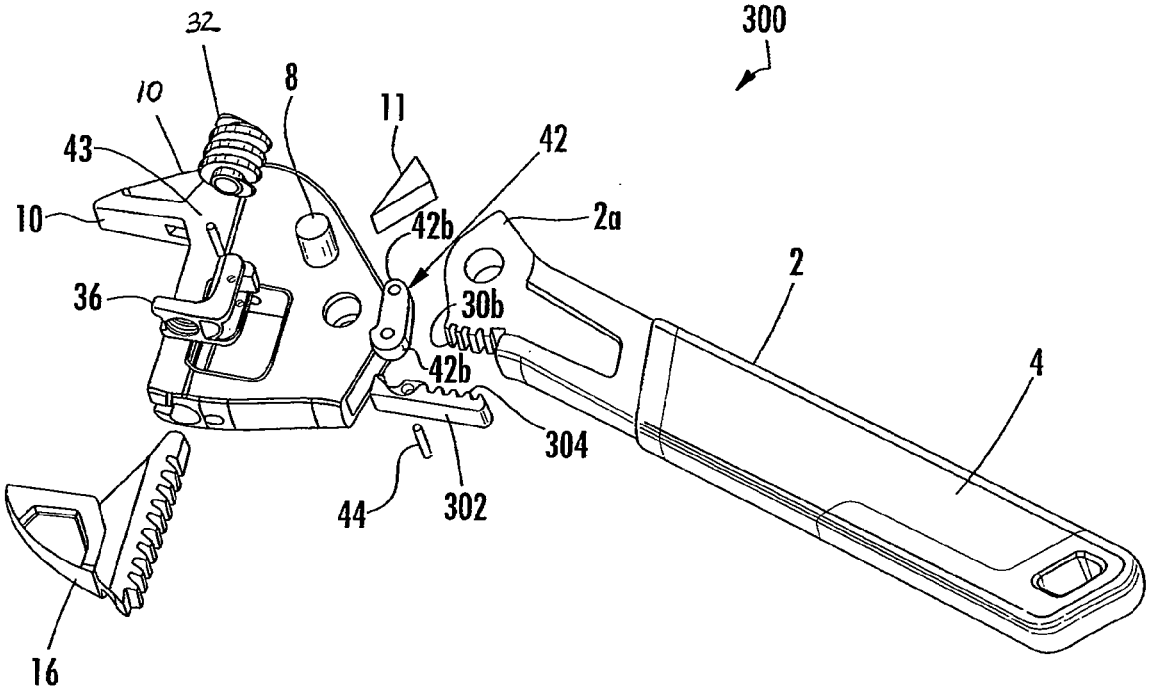
FIG. 19 is an exploded view of another embodiment of the wrench of the invention.

Another embodiment of the wrench of the invention is shown generally at 300 in FIG. 19 where like reference numerals are used to identify like components previously described with reference to the embodiment of FIGS. 1 through 9. Some of the components previously described with respect to the embodiment of FIG. 1 have been omitted from the embodiment shown in FIG. 19 for clarity of illustration. It is to be understood that such non-illustrated components form a part of the wrench of FIG. 19 and operate in the same manner as in the embodiment of FIG. 1. In the embodiment of FIG. 19 link 42 has its one end 42*b* pivotably connected to the cassette 36 by pin 43, the opposite end 42*a* of link 42 is pivotably connected to rack 302 by pin 44. Rack 302 has teeth 304 that engage gear teeth 306 formed on the connecting portion 2*a* of handle 2. As handle 2 is rotated relative to body portion 6 the engagement of teeth 304 with teeth 306 causes rack 302 to reciprocate in body portion 6 in a direction substantially perpendicular to the direction of movement of movable jaw 16. As rack 302 reciprocates it will move the end 42*b* of link 42 to positively rotate link 42 into and out of the dead/over-center position. In operation, wrench 300 operates in the same manner as the embodiment of FIGS. 1 through 9 except for the operation of rack 302 to positively move link 42 as previously described. It will be appreciated that other linkages may be used to effectuate movement of the link 42 into and out of the dead/over-center position.

Specific embodiments of an invention are disclosed herein. One of ordinary skill in the art will recognize that the invention has other applications in other environments. Many embodiments are possible. The following claims are in no way intended to limit the scope of the invention to the specific embodiments described above.

The invention claimed is:

1. A ratcheting wrench comprising:

a handle pivotably connected a first jaw;

a second jaw adjustably mounted relative to the first jaw in a first direction;

the pivoting of the handle relative to the first jaw moves the second jaw towards and away from the first jaw and engages a locking mechanism that locks the second jaw in position relative to the first jaw, said locking mechanism comprising a first link being pivotably connected to said handle at a first pivot and to a cassette at a second pivot, said cassette being mounted on said first jaw such that it can reciprocate along said first direction.

2. The wrench of claim 1 further including a body portion supporting the first jaw for pivotal movement relative to the handle.

3. The wrench of claim 2 further including a spring maintaining a neutral relationship between the body portion and the handle.

4. The wrench of claim 2 including a drive mechanism for adjusting the distance between the first jaw and the second jaw, wherein the drive mechanism includes a first member in said body portion engageable with said movable jaw.

5. The wrench of claim 4 wherein said first member includes a screw.

6. The wrench of claim 4 wherein the drive member is mounted such that the drive member can move with said movable jaw.

7. The wrench of claim 1 wherein said first link occupies an over-center position when in a locked position, said over-center position being a position where a line between said first pivot and said second pivot is at an angle relative to said first direction.

8. The wrench of claim 7 including a drive mechanism for adjusting the distance between the first jaw and the second jaw.

9. The wrench of claim 1 wherein said first link occupies a deadcenter position when in a locked position, said dead-center position being a position where a line between said first pivot and said second pivot is parallel to said first direction.

10. The wrench of claim 1 wherein said cassette is connected to a drive mechanism, said drive mechanism adjusting the distance between the first jaw and the second jaw.

11. The wrench of claim 1 wherein the first jaw and the second jaw are spaced a distance corresponding to the size of a workpiece and the second jaw is allowed to move closer to the first jaw when the handle is rotated in a first direction.

12. The wrench of claim 1 wherein as the locking mechanism locks the second jaw in position relative to the first jaw, the second jaw is moved closer to the first jaw.

13. The wrench of claim 1 wherein as the locking mechanism locks the second jaw in position relative to the first jaw, portions of the wrench deflect thereby increasing the force exerted by the jaws.

14. A ratcheting wrench comprising:

a handle pivotably connected a first jaw;

a second jaw adjustably mounted relative to the first jaw;

the pivoting of the handle relative to the first jaw moves the second jaw towards and away from the first jaw and engages a locking mechanism that locks the second jaw in position relative to the first jaw; said locking mechanism comprising a first link pivotably connected to said handle at a first pivot and to a cassette at a second pivot, said cassette being movably mounted on said first jaw wherein as the locking mechanism locks the second jaw in position relative to the first jaw, the second jaw is moved closer to the first jaw and at least one of said first link and cassette deflect thereby increasing the force exerted by the jaws.

15. A wrench comprising:

a handle pivotably connected to a first jaw and having at least one tooth formed thereon;

a second jaw adjustably mounted relative to the first jaw;

a ratchet bar supporting the second jaw and having a second set of teeth formed thereon, said at least one tooth engaging said second set of teeth;

the pivoting of the handle relative to the first jaw moves the second jaw towards and away from the first jaw.

16. The wrench of claim 15 wherein said second jaw is slidably mounted on said ratchet bar.

17. The wrench of claim 15 further including a lock for locking the second jaw in a position relative to said ratchet bar.

18. The wrench of claim 15 further including means for spacing the first jaw from the second jaw a distance from one another to accommodate a workpiece therebetween.

19. The wrench of claim 18 wherein the means for spacing includes a recess formed on one of said jaws.

20. The wrench of claim 19 wherein the recess allows the jaws to be spaced from one another a distance less than the width of the workpiece.

21. The wrench of claim 15 further including a spring for biasing the handle in a neutral position relative to the first jaw.

22. The wrench of claim 15 wherein said ratchet bar is slidably mounted relative to said first jaw.

23. A wrench comprising:

a handle pivotably connected to a first jaw and having at least one first tooth formed thereon;

a second jaw adjustably mounted relative to the first jaw;

a ratchet bar supporting the second jaw and having at least one second tooth formed thereon, said at least one first tooth engaging said at least one second tooth;

the pivoting of the handle relative to the first jaw moves the second jaw towards and away from the first jaw.

24. A ratcheting wrench comprising:

a handle pivotably connected a first jaw;

a second jaw;

a drive mechanism for adjusting the distance between the first jaw and the second jaw along a first direction;

a locking mechanism that locks the second jaw in position relative to the first jaw when said handle is pivoted in a first direction, said locking mechanism comprising a first link being pivotably connected to said handle at a first pivot and to a cassette at a second pivot, said cassette being mounted to said drive mechanism wherein said first link occupies a position when in a locked position where a line between said first pivot and said second pivot is generally parallel to said first direction but at a slight angle relative to said first direction whereby a backdrive force on the jaws tends to pivot said link away from said first direction.

25. The ratcheting wrench of claim 24 wherein said link moves from a first position to said position through another position that is parallel to said direction.

* * * * *